US011406886B1

(12) United States Patent
Thomas

(10) Patent No.: US 11,406,886 B1
(45) Date of Patent: Aug. 9, 2022

(54) PUNCHING BAG HAVING TWO SECTIONS

(71) Applicant: William Thomas, Staten Island, NY (US)

(72) Inventor: William Thomas, Staten Island, NY (US)

( * ) Notice: Subject to any disclaimer, the term of this patent is extended or adjusted under 35 U.S.C. 154(b) by 136 days.

(21) Appl. No.: 16/995,949

(22) Filed: Aug. 18, 2020

(51) Int. Cl.

| | |
|---|---|
| ***A63B 69/20*** | (2006.01) |
| ***A63B 69/24*** | (2006.01) |
| ***A63B 69/00*** | (2006.01) |
| ***A63B 69/34*** | (2006.01) |
| ***A63B 71/14*** | (2006.01) |

(52) U.S. Cl.
CPC ..... *A63B 69/201* (2013.01); *A63B 69/203* (2013.01); *A63B 69/205* (2013.01); *A63B 69/004* (2013.01); *A63B 69/0086* (2013.01); *A63B 69/20* (2013.01); *A63B 69/206* (2013.01); *A63B 69/208* (2013.01); *A63B 69/24* (2013.01); *A63B 69/34* (2013.01); *A63B 71/14* (2013.01); *A63B 2209/00* (2013.01); *A63B 2220/53* (2013.01); *A63B 2244/10* (2013.01); *A63B 2244/102* (2013.01)

(58) Field of Classification Search
CPC . A63B 69/00; A63B 69/0073; A63B 69/0075; A63B 69/20; A63B 69/201; A63B 69/203; A63B 69/205; A63B 69/206; A63B 69/208; A63B 69/24; A63B 69/26; A63B 69/32; A63B 69/325; A63B 69/0079; A63B 69/0084; A63B 69/0086; A63B 69/0088; A63B 69/0091; A63B 69/34; A63B 69/345; A63B 69/004; A63B 2069/0077; A63B 2069/0082; A63B 2220/50; A63B 2220/51; A63B 2220/52; A63B 2220/53; A63B 2220/54; A63B 2220/56; A63B 71/14; A63B 71/141; A63B 71/145; A63B 2244/102; A63B 2244/10; A63B 2244/104; A63B 2244/106; A63B 2244/108; A63B 21/0608; A63B 2209/00
USPC ..... 482/87, 83
See application file for complete search history.

(56) References Cited

U.S. PATENT DOCUMENTS 1,267,678 A * 5/1918 McArdle et al. .... A63B 69/004 482/89
1,481,594 A * 1/1924 Fitzgerald ..... A63B 69/208 40/608

(Continued)

FOREIGN PATENT DOCUMENTS

WO 9428981 12/1994
WO 2012089194 7/2012

*Primary Examiner* — Megan Anderson
*Assistant Examiner* — Thao N Do
(74) *Attorney, Agent, or Firm* — Kyle A. Fletcher, Esq.

(57) ABSTRACT

The punching bag having two sections is a physical training apparatus. The punching bag having two sections is adapted for use in training participants in combat sports. The punching bag having two sections presents a plurality of targets that are struck during training activities. The punching bag having two sections incorporates a plurality of punching bags, an internal fastener, and a harness. The internal fastener interconnect the plurality of punching bags. The harness limits the motion of a first punching bag selected from the plurality of punching bags relative to a second punching bag selected from the plurality of punching bags. Each of the plurality of punching bags forms a target selected from the plurality of targets.

15 Claims, 5 Drawing Sheets

(56) References Cited

U.S. PATENT DOCUMENTS 1,817,364 A * 8/1931 Goldsmith ..... A63B 69/345 482/89
2,466,954 A * 4/1949 King ..... A63B 69/345 473/443
2,826,416 A * 3/1958 Heffner ..... A63B 69/201 482/86
3,337,217 A * 8/1967 Cummins ..... A63B 69/345 473/442
3,785,643 A * 1/1974 Rich ..... A63B 67/10 D21/466
4,103,889 A * 8/1978 Lobur ..... A63B 69/201 273/DIG. 20
4,434,980 A * 3/1984 Babineaux ..... A63B 69/20 482/89
4,491,315 A * 1/1985 Dye ..... A63B 69/201 473/442
5,183,450 A * 2/1993 Stelmach ..... A63B 69/20 473/442
5,702,327 A * 12/1997 Fullbright ..... A63B 69/20 473/441
5,769,761 A * 6/1998 Zagata, Jr. ..... A63B 69/34 482/90
5,863,278 A * 1/1999 Chen ..... A63B 69/20 482/90
5,902,217 A * 5/1999 Schechner ..... A63B 69/004 482/90
6,063,011 A * 5/2000 Pelchat ..... A63B 69/004 482/90
6,244,993 B1 * 6/2001 Dunn ..... A63B 69/201 482/90
6,302,831 B1 * 10/2001 Henry ..... A63B 69/004 482/90
6,432,027 B1 * 8/2002 Haselrig ..... A63B 69/201 482/90
6,461,281 B2 * 10/2002 Bouvier ..... A63B 69/201 482/86
8,273,000 B2 * 9/2012 Evans ..... A63B 69/201 482/86
8,876,671 B1 * 11/2014 Hurtato, Jr. ..... A63B 69/201 482/87
9,149,703 B2 10/2015 Partio
9,211,465 B1 * 12/2015 Lambrinos ..... A63B 69/201
9,925,448 B2 * 3/2018 Hockridge ..... A63B 71/023
10,398,959 B2 * 9/2019 Hall ..... A63B 24/0087
10,716,988 B2 * 7/2020 Slechta ..... A63B 69/20
10,912,978 B2 * 2/2021 Bortolotto ..... A63B 69/201
10,926,149 B2 * 2/2021 Scott ..... A63B 69/206
10,974,119 B1 * 4/2021 Julian ..... A63B 69/201
2002/0010057 A1 * 1/2002 Bouvier ..... A63B 69/201 482/86
2002/0115538 A1 * 8/2002 Wen ..... A63B 69/34 482/83
2009/0318272 A1 * 12/2009 Evans ..... A63B 69/0053 482/86
2010/0179031 A1 * 7/2010 Luigi ..... A63B 69/34 482/148
2010/0261584 A1 * 10/2010 Tsakiris ..... A63B 69/201 482/86
2016/0184684 A1 * 6/2016 Ray ..... A63B 69/004 482/89
2016/0206943 A1 * 7/2016 Campbell ..... A63B 69/205
2017/0021255 A1 1/2017 Knight
2018/0147470 A1 * 5/2018 Howard ..... A63B 23/0355
2018/0256957 A1 * 9/2018 Slechta, Jr. ..... A63B 69/20
2019/0118059 A1 * 4/2019 Partlo ..... A63B 69/201
2019/0217176 A1 * 7/2019 Slechta ..... A63B 69/201
2019/0282880 A1 * 9/2019 Bortolotto ..... A63B 69/201
2020/0094097 A1 * 3/2020 Gonzalez ..... A63B 21/0084
2020/0391091 A1 * 12/2020 Lei ..... A63B 69/201
2021/0178241 A1 * 6/2021 Jones ..... A63B 69/32

* cited by examiner

PUNCHING BAG HAVING TWO SECTIONS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of apparatus for physical training including training apparatus for special sports, boxing training devices that comprise a hanging heavy bag. (A63B69/201)

SUMMARY OF INVENTION

The punching bag having two sections is a physical training apparatus. The punching bag having two sections is adapted for use in training participants in combat sports. The punching bag having two sections presents a plurality of targets that are struck during training activities. The punching bag having two sections incorporates a plurality of punching bags, an internal fastener, and a harness. The internal fastener interconnect the plurality of punching bags. The harness limits the motion of a first punching bag selected from the plurality of punching bags relative to a second punching bag selected from the plurality of punching bags. Each of the plurality of punching bags forms a target selected from the plurality of targets.

These together with additional objects, features and advantages of the punching bag having two sections will be readily apparent to those of ordinary skill in the art upon reading the following detailed description of the presently preferred, but nonetheless illustrative, embodiments when taken in conjunction with the accompanying drawings.

In this respect, before explaining the current embodiments of the punching bag having two sections in detail, it is to be understood that the punching bag having two sections is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the punching bag having two sections.

It is therefore important that the claims be regarded as including such equivalent construction insofar as they do not depart from the spirit and scope of the punching bag having two sections. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
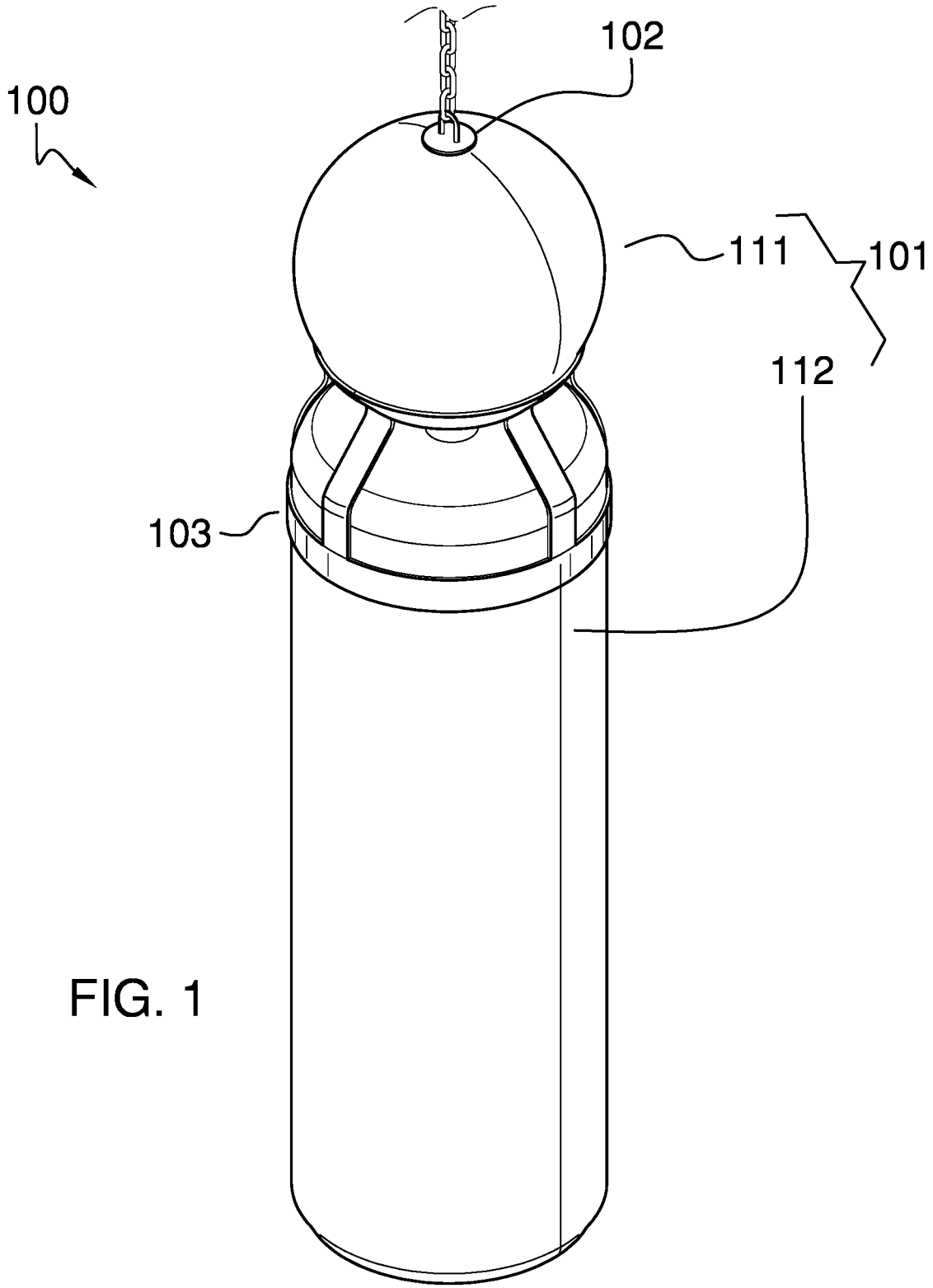
FIG. 1 is a perspective view of an embodiment of the disclosure.
Figure 2:
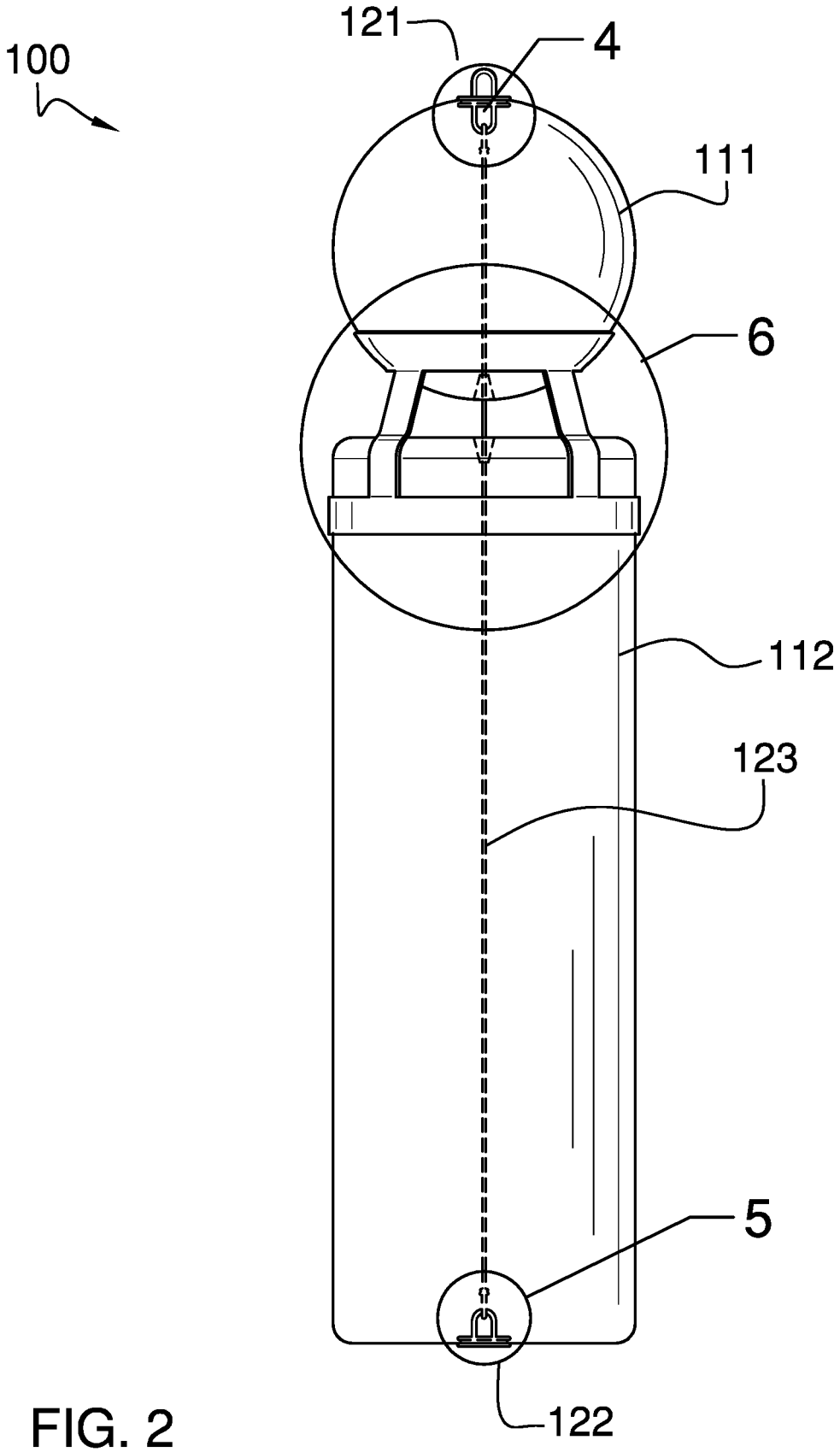
FIG. 2 is a front view of an embodiment of the disclosure.
Figure 3:
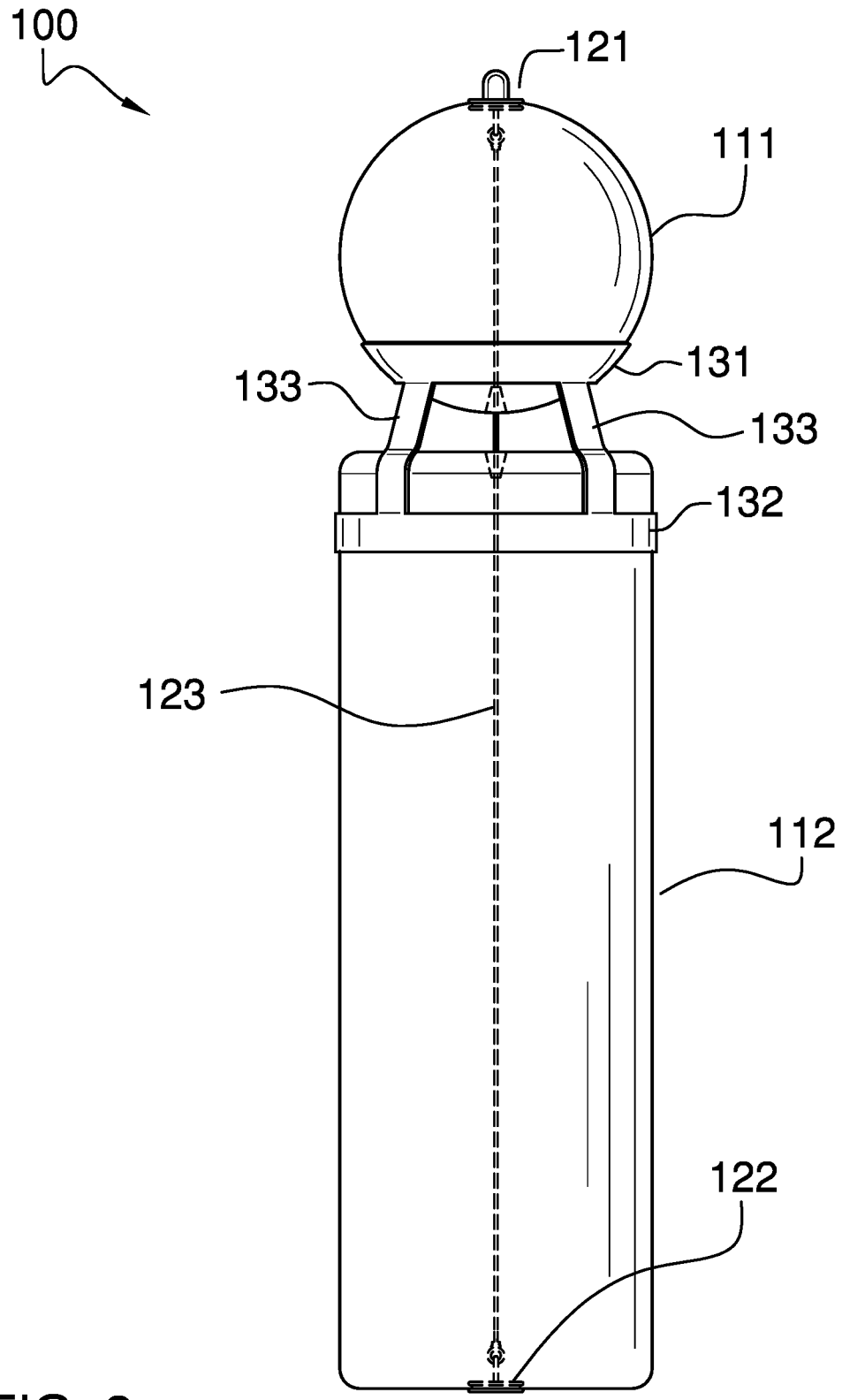
FIG. 3 is a side view of an embodiment of the disclosure.
Figure 4:
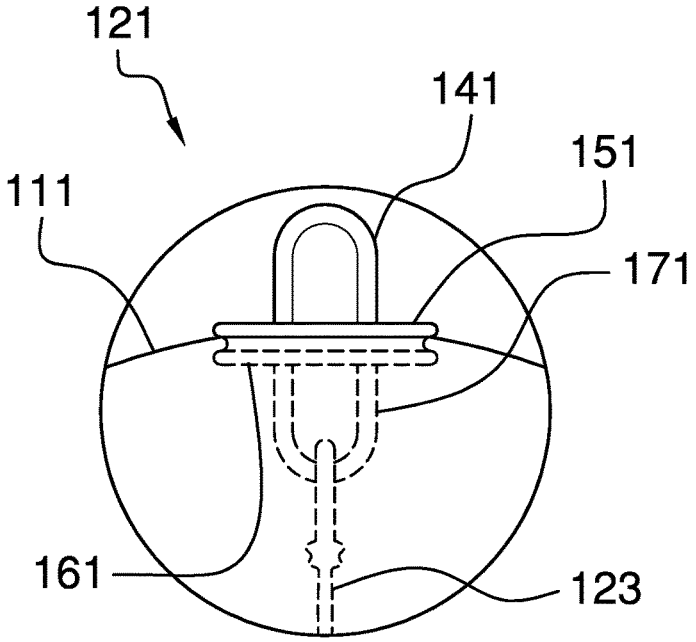
FIG. 4 is a detail view of an embodiment of the disclosure.
Figure 5:
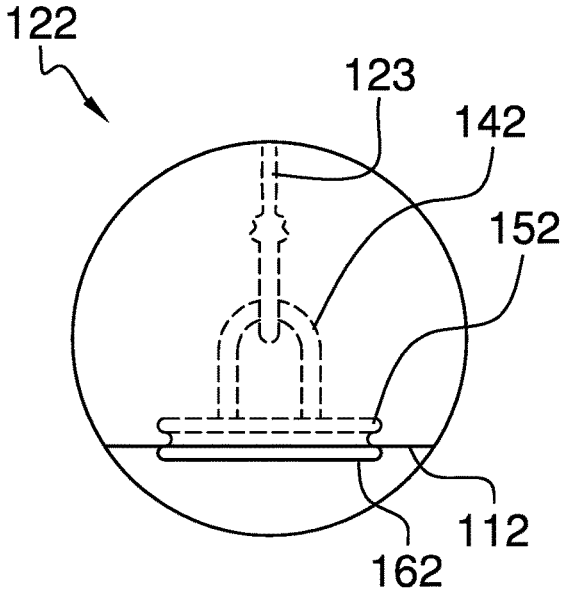
FIG. 5 is a detail view of an embodiment of the disclosure.
Figure 6:
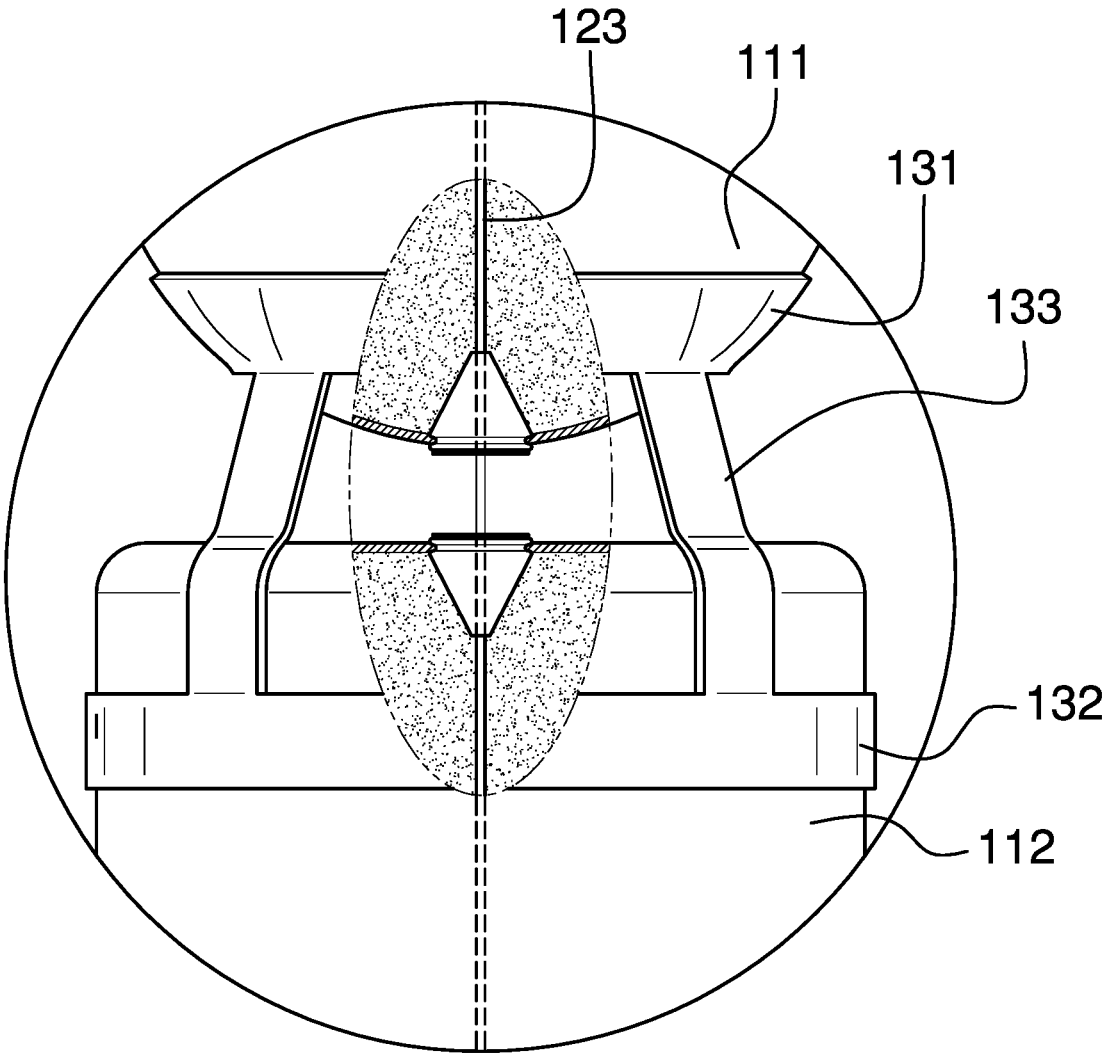
FIG. 6 is a detail view of an embodiment of the disclosure.

Detailed reference will now be made to one or more potential embodiments of the disclosure, which are illustrated in FIGS. 1 through 6.

The punching bag having two sections 100 (hereinafter invention) is a physical training apparatus. The invention 100 is adapted for use in training participants in combat sports. The invention 100 presents a plurality of targets that are struck during training activities. The invention 100 comprises a plurality of punching bags 101, an internal fastener 102, and a harness 103. The internal fastener 102 interconnects the plurality of punching bags 101. The harness 103 limits the motion of a first punching bag selected from the plurality of punching bags 101 relative to a second punching bag selected from the plurality of punching bags 101. Each of the plurality of punching bags 101 forms a target selected from the plurality of targets.

Each of the plurality of punching bags 101 is a punching bag. The punching bag is defined elsewhere in this disclosure. Each of the plurality of punching bags 101 receives the impacts of targeted strikes that are made during the physical training process. The plurality of punching bags 101 are interconnected. The plurality of punching bags 101 form a composite prism structure. The plurality of punching bags 101 are suspended above a supporting surface. The composite prism structure of the plurality of punching bags 101 is oriented such that the center axis of the plurality of punching bags 101 aligns with the force of gravity. The plurality of punching bags 101 comprises an undercut bag 111 and a heavy bag 112.

The undercut bag 111 is a type of punching bag used in the training of punching combinations. The undercut bag 111 has a roughly spherical shape. The undercut bag 111 is defined elsewhere in this disclosure. The heavy bag 112 is a type of punching bag used in the strength training and the training of punching at a torso. The heavy bag 112 is a prism-shaped structure. In the first potential embodiment of the disclosure, the heavy bag 112 has a roughly cylindrical shape. The heavy bag 112 is defined elsewhere in this disclosure. The internal fastener 102 attaches the undercut bag 111 to the heavy bag 112. The undercut bag 111, the internal fastener 102, and the heavy bag 112 are interconnected to form the composite prism structure of the plurality of punching bags 101 and the invention 100. The undercut bag 111 maintains a superior position to the heavy bag 112 when the invention 100 is suspended for use.

The internal fastener 102 is a mechanical structure. The internal fastener 102 interconnects the plurality of punching bags 101 such that the plurality of punching bags 101 and the internal fastener 102 combine to form the composite prism structure of the plurality of punching bags 101. The internal fastener 102 aligns with the center axis of the composite prism structure of the assembled plurality of punching bags 101. The internal fastener 102 comprises a superior connector 121, an inferior connector 122, and a center cord 123.

The superior connector 121 is a fastening device. The superior connector 121 is positioned at the apex of the invention 100. The superior connector 121 forms a first anchor point that attaches the center cord 123 to the undercut bag 111. The superior connector 121 forms a second anchor point that allows for the invention 100 to be suspended above a supporting surface by an externally provisioned structure such as a second cord. The superior connector 121 comprises a first superior ring 141, a first top disk 151, a first bottom disk 161, and an inferior ring 171.

The first superior ring 141 is a ring shaped structure. The first superior ring 141 attaches to the surface of the first top disk 151 that is distal from the first bottom disk 161. The first superior ring 141 forms the anchor point to which an externally provisioned cord attaches to suspend the invention 100. The inferior ring 171 is a ring shaped structure. The inferior ring 171 attaches to the surface of the first bottom disk 161 that is distal from the first top disk 151. The inferior ring 171 forms the anchor point used by the center cord 123 to attach the undercut bag 111 to the heavy bag 112.

The first top disk 151 is a disk-shaped structure. The first bottom disk 161 is a disk-shaped structure. The face of the first top disk 151 that is distal from the first superior ring 141 attaches to the face of the first bottom disk 161 that is distal from the inferior ring 171. The first top disk 151 attaches to the first bottom disk 161 such that the exterior surface of the undercut bag 111 is sandwiched between the first top disk 151 and the first bottom disk 161. The first top disk 151 permanently attaches to the first bottom disk 161 such that the superior connector 121 is permanently secured to the undercut bag 111.

The inferior connector 122 is a fastening device. The inferior connector 122 is positioned at the nadir of the invention 100. The inferior connector 122 forms a third anchor point that attaches the center cord 123 to the heavy bag 112. The inferior connector 122 comprises a second superior ring 142, a second top disk 152, and a second bottom disk 162.

The second top disk 152 is a disk-shaped structure. The second bottom disk 162 is a disk-shaped structure. The face of the second top disk 152 that is distal from the second superior ring 142 attaches to the face of the second bottom disk 162 that is distal from the inferior ring 171. The second top disk 152 attaches to the second bottom disk 162 such that the exterior surface of the heavy bag 112 is sandwiched between the second top disk 152 and the second bottom disk 162. The second top disk 152 permanently attaches to the second top disk 152 such that the inferior connector 122 is permanently secured to the heavy bag 112.

The second superior ring 142 is a ring shaped structure. The second superior ring 142 attaches to the surface of the second top disk 152 that is distal from the second bottom disk 162. The second superior ring 142 forms the anchor point used by the center cord 123 to attach the heavy bag 112 to the undercut bag 111.

The center cord 123 forms a cord that attaches the undercut bag 111 to the heavy bag 112. The cord is defined elsewhere in this disclosure. The center cord 123 runs through the interior spaces of the undercut bag 111 and the heavy bag 112. The center cord 123 forms a load path that bears the full load of the heavy bag 112 when the invention 100 is suspended for use. The center cord 123 forms a load path that transfers the full load of the heavy bag 112 to the superior connector 121 of the internal fastener 102 when the invention 100 is suspended for use. In the first potential embodiment of the disclosure, the center cord 123 is a chain.

The harness 103 is a mechanical structure. The harness 103 is defined elsewhere in this disclosure. The harness 103 secures any first punching bag selected from the plurality of punching bags 101 to one or more second bags selected from the plurality of punching bags 101 such that the span of the range of motion of the first punching bag relative to the second punching bag is limited. In the first potential embodiment of the disclosure, the harness 103 does not form a link in the load path of the invention 100. The harness 103 comprises an undercut bag 111 band 131, a heavy bag 112 band 132, and a plurality of limit straps 133.

The undercut bag 111 band 131 is a textile based structure. The undercut bag 111 band 131 is a webbing. The undercut bag 111 band 131 is attached to itself to form a band. The band is defined elsewhere in this disclosure. By attached to itself is meant that a sewn seam attaches: a) the edge of the perimeter of the undercut bag 111 band 131 with the least span of length; to b) the edge of the perimeter of the undercut bag 111 band 131 that is distal from the edge of the perimeter of the undercut bag 111 band 131 with the least span of length. The undercut bag 111 band 131 binds the harness 103 to the undercut bag 111.

The heavy bag 112 band 132 is a textile based structure. The heavy bag 112 band 132 is a webbing. The heavy bag 112 band 132 is attached to itself to form a band. The band is defined elsewhere in this disclosure. By attached to itself is meant that a sewn seam attaches: a) the edge of the perimeter of the heavy bag 112 band 132 with the least span of length; to, b) the edge of the perimeter of the heavy bag 112 band 132 that is distal from the edge of the perimeter of the heavy bag 112 band 132 with the least span of length. The heavy bag 112 band 132 binds the harness 103 to the undercut bag 111.

Each of the plurality of limit straps 133 is a textile based structure. Each of the plurality of limit straps 133 is a webbing. The edge of the perimeter of each of the plurality of limit straps 133 with the least span of length attaches to the face of the undercut bag 111 band 131. The edge of the perimeter of each of the plurality of limit straps 133 that is distal from the edge of the perimeter of the undercut bag 111 band 131 with the least span of length attaches to the face of the heavy bag 112 band 132.

Each of the plurality of limit straps 133 loosely binds the undercut bag 111 band 131 to the heavy bag 112 band 132. By loosely bound is meant that the tensile strength of each of the plurality of limit straps 133 limits the span of the distance between the undercut bag 111 and the heavy bag 112 to the span of the length of the limit strap that is bearing the tensile forces separating the undercut bag 111 from the heavy bag 112. By loosely bound is further meant that the undercut bag 111 moves freely relative to the heavy bag 112 when none of the limiting straps contained in the plurality of limit straps 133 bears a tensile load.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Apex and Nadir: As used in this disclosure, the apex and nadir refer to the locations of an object. The apex of an object is the location on the object with the greatest elevation when the object is in its normal operating position. The apex of an object is the location on the object with the lowest elevation when the object is in its normal operating position.

Band: As used in this disclosure, a band is a flat loop of material.

Bind: As used in this disclosure, to bind is a verb that means to tie or secure a first object to a second object using a strap, cord or webbing.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chain: As used in this disclosure, a chain is a series of interlinked rings that form a cord like structure. Like a cord, a chain has tensile strength but is too flexible to provide compressive strength and is not suitable for use in pushing objects. The rings to form a chain are often formed from a metal.

Composite Prism: As used in this disclosure, a composite prism refers to a structure that is formed from a plurality of structures selected from the group consisting of a prism structure, a pyramid structure, a wedge, and a spherical structure. The plurality of selected structures may or may not be truncated. The plurality of prism structures are joined together such that the center axes (or spherical diameter) of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hang: As used in this disclosure, to hang an object is to suspend an object above a supporting surface from above such that the inferior end of the object can move freely.

Harness: As used in this disclosure, a harness is an apparatus used to fasten or anchor a first person or first object to a second object. The phrase N point harness refers to the installation of the harness wherein the harness has N anchor points. For example, a 2 point harness has two anchor points while a 5 point harness has 5 anchor points.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Impact: As used in this disclosure, an impact refers to an exchange of momentum between two objects over a duration. An impact often refers to a collision between two objects.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Punching Bag: As used in this disclosure, a punching bag is a structure that is suspended above the ground. The punching bag is designed to receive punches and other blows from exercisers for physical training purposes, especially for combat sports such as boxing or mixed martial arts. Punching bags are differentiated by form and weight. Traditionally a heavy bag is cylindrically shaped punching bag that is intended to simulate the torso of an opponent. The heavy bag has a weight that emulates the weight of a torso. The speed bag is traditionally spherically or pear shaped. The speed bag is a light weight structure (less than 10 pounds) used for hand eye coordination training. The undercut bag is a spherical structure of intermediate weight. By intermediate weight is meant that the weight of the undercut bag is between the weight of the heavy bag and a speed bag. The undercut bag is used as a target structure used to teach and practice punch combinations.

Ring: As used in this disclosure, a ring is term that is used to describe a disk-like structure through which a negative space is formed. Rings are often considered loops.

Roughly: As used in this disclosure, roughly refers to a comparison between two objects. Roughly means that the difference between one or more parameters of the two compared objects are not significantly different.

Sandwich: As used in this disclosure, to sandwich means to insert a first disk-shaped structure between a second disk-shaped structure and a third disk-shaped structure to form a composite prism structure. Specifically: a) a first congruent end of the first disk-shaped structure is placed against a first interior congruent end of the second disk-shaped structure; and, b) a second congruent end of the first disk-shaped structure is placed against a second interior congruent end of the third disk-shaped structure. A first exterior congruent end of the second disk-shaped structure forms a firs overall congruent end of the overall composite prism structure described in this definition. A second exterior congruent end of the third disk-shaped structure forms a second overall congruent end of the overall composite prism structure described in this definition. The second overall congruent end of the overall composite prism structure is distal from the first overall congruent end. The verb to sandwich describes the act of placing the second disk-shaped structure between the first disk-shaped structure and the third disk-shaped structure.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, a laser seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sphere: As used in this disclosure, a sphere refers to a structure wherein every point of the surface of the structure is equidistant from a center point.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object.

Target: As used in this disclosure, a target is an object used by an individual to display or improve proficiency with striking an intended location.

Textile: As used in this disclosure, a textile is a material that is woven, knitted, braided or felted. Synonyms in common usage for this definition include fabric and cloth. The two surfaces of the textile with the greatest surface area are called the faces of the textile.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A punching bag with two sections comprising
- a plurality of punching bags, an internal fastener, and a harness;
- wherein the internal fastener interconnect the plurality of punching bags;
- wherein the punching bag with the two sections is a physical training apparatus;
- wherein the punching bag with the two sections is adapted for use in training participants in combat sports;
- wherein the plurality of punching bags is further defined as an undercut bag and a heavy bag;
- wherein the internal fastener comprises a superior connector, an inferior connector, and a center cord;
- wherein the center cord attaches the inferior connector to the superior connector;
- wherein the harness comprises an undercut bag band, a heavy bag band, and a plurality of limit straps;
- wherein the plurality of limit straps attach the undercut bag band to the heavy bag band.

2. The punching bag with the two sections according to claim 1 wherein each of the plurality of punching bags forms a target;
- wherein each of the plurality of punching bags is a punching bag;
- wherein each of the plurality of punching bags receives impacts of targeted strikes that are made during a physical training process.

3. The punching bag with the two sections according to claim 2 wherein the plurality of punching bags are interconnected;
- wherein the plurality of punching bags form a composite structure;
- wherein the plurality of punching bags are suspended above a supporting surface;
- wherein the composite structure of the plurality of punching bags is oriented such that a center axis of the plurality of punching bags aligns with a force of gravity.

4. The punching bag with the two sections according to claim 3 wherein the internal fastener attaches the undercut bag to the heavy bag;
- wherein the undercut bag, the internal fastener, and the heavy bag are interconnected to form the composite structure of the plurality of punching bags and the punching bag with the two sections;
- wherein the undercut bag maintains a superior position to the heavy bag when the punching bag with two sections is suspended.

5. The punching bag with the two sections according to claim 4 wherein the harness is a mechanical structure;
- wherein the harness secures the undercut bag, and the heavy bag such that a span of a range of motion of the undercut bag relative to the heavy bag is limited.

6. The punching bag with the two sections according to claim 5
- wherein the undercut bag is a type of punching bag used in a training of punching combinations;
- wherein the heavy bag is a type of punching bag used in a strength training and the training of punching at a torso.

7. The punching bag with the two sections according to claim 6 wherein the undercut bag has a spherical shape;
- wherein the heavy bag has a cylindrical shape.

8. The punching bag with the two sections according to claim 7 wherein the superior connector is positioned at an apex of the punching bag with two sections;

wherein the superior connector forms a first anchor point that attaches the center cord to the undercut bag;

wherein the superior connector forms a second anchor point that allows for the punching bag with the two sections to be suspended above a supporting surface by an externally provisioned structure.

9. The punching bag with the two sections according to claim 8 wherein the inferior connector is positioned at a nadir of the punching bag with the two sections;

wherein the inferior connector forms a third anchor point that attaches the center cord to the heavy bag.

10. The punching bag with the two sections according to claim 9 wherein the center cord forms a cord that attaches the undercut bag to the heavy bag;

wherein the center cord runs through interior spaces of the undercut bag and the heavy bag;

wherein the center cord forms a load path that bears a full load of the heavy bag when the punching bag with the two sections is suspended for use;

wherein the center cord forms the load path that transfers the full load of the heavy bag to the superior connector of the internal fastener when the punching bag with the two sections is suspended.

11. The punching bag with the two sections according to claim 10 wherein the superior connector comprises a first superior ring, a first top disk, a first bottom disk, and an inferior ring;

wherein the first superior ring is a ring shaped structure;

wherein the first superior ring attaches to a surface of the first top disk that is distal from the first bottom disk;

wherein the first superior ring forms an anchor point to which an externally provisioned cord attaches to suspend the punching bag with the two sections;

wherein the inferior ring is a ring shaped structure;

wherein the inferior ring attaches to a surface of the first bottom disk that is distal from the first top disk;

wherein the inferior ring forms an anchor point used by the center cord to attach the undercut bag to the heavy bag;

wherein the first top disk is a disk-shaped structure;

wherein the first bottom disk is a disk-shaped structure;

wherein a face of the first top disk that is distal from the first superior ring attaches to a face of the first bottom disk that is distal from the inferior ring;

wherein the first top disk attaches to the first bottom disk such that an exterior surface of the undercut bag is sandwiched between the first top disk and the first bottom disk;

wherein the first top disk permanently attaches to the first bottom disk such that the superior connector is permanently secured to the undercut bag.

12. The punching bag with the two sections according to claim 11 wherein the inferior connector comprises a second superior ring, a second top disk, and a second bottom disk;

wherein the second top disk is a disk-shaped structure;

wherein the second bottom disk is a disk-shaped structure;

wherein a face of the second top disk that is distal from the second superior ring attaches to a face of the second bottom disk that is distal from the inferior ring;

wherein the second top disk attaches to the second bottom disk such that an exterior surface of the heavy bag is sandwiched between the second top disk and the second bottom disk;

wherein the second top disk permanently attaches to the second top disk such that the inferior connector is permanently secured to the heavy bag;

wherein the second superior ring is a ring shaped structure;

wherein the second superior ring attaches to a surface of the second top disk that is distal from the second bottom disk;

wherein the second superior ring forms an anchor point used by the center cord to attach the heavy bag to the undercut bag.

13. The punching bag with the two sections according to claim 12 wherein the undercut bag band is a textile based structure;

wherein the undercut bag band is a webbing;

wherein the undercut bag band is attached to itself to form a band;

wherein the undercut bag band binds the harness to the undercut bag.

14. The punching bag with the two sections according to claim 13 wherein the heavy bag band is a textile based structure;

wherein the heavy bag band is a webbing;

wherein the heavy bag band is attached to itself to form a band;

wherein the heavy bag band binds the harness to the undercut bag.

15. The punching bag with the two sections according to claim 2 wherein the center cord is a chain;

wherein the harness does not form a link in the load path of the punching bag with the two sections.

* * * * *